United States Patent [19]

Ferguson

[11] 4,093,191

[45] June 6, 1978

[54] SAFETY DEVICE FOR WELDING TORCH

[76] Inventor: Charles L. Ferguson, 4303 Fluhr Dr., Louisville, Ky. 40216

[21] Appl. No.: 743,094

[22] Filed: Nov. 19, 1976

[51] Int. Cl.[2] ..... B23K 7/00

[52] U.S. Cl. ..... 266/48; 266/74; 239/289

[58] Field of Search ..... 148/9 R; 169/54, 70; 239/289; 266/48, 74, 75

[56] References Cited

U.S. PATENT DOCUMENTS

| | | | |
|---|---|---|---|
| 3,398,609 | 8/1968 | Schott | 239/289 |
| 3,612,086 | 10/1971 | Roth | 266/74 X |
| 3,945,440 | 3/1970 | Bohme | 169/54 |

*Primary Examiner*—Roy Lake
*Assistant Examiner*—Paul A. Bell
*Attorney, Agent, or Firm*—Edward M. Steutermann

[57] ABSTRACT

In an arrangement for use in burning and cutting torches and like devices where the torch utilizes an oxidizing medium supplied to the torch at a selected pressure and a fuel supplied to the torch at a selected pressure, where the fuel and oxidizing medium are independently supplied to the cutting torch and mixed therein, the present invention provides a fire extinguishing medium, supplied under pressure to the cutting torch vicinity, where the pressure of the extinguishing medium supply source is utilized to operate valve means to control the flow of oxidizer and fuel.

4 Claims, 4 Drawing Figures

SAFETY DEVICE FOR WELDING TORCH

BACKGROUND OF THE INVENTION

The present invention provides a safety device for use in connection with certain welding apparatus, for example, acetylene/oxygen cutting torches and welding devices. Conventional cutting or burning torches have found wide application in industry, especially in the metal working industries and the like. Such welding apparatus utilizes highly combustible fuel in combination with a combustion supporting fluid, such as oxygen, where the combining of these fluids and ignition, produces extreme heat.

Because of the extreme heat developed in the operating area of the torch, any extraneous combustible materials present in the vicinity of the work are ignited. In some cases extremely serious situations develop by the accidental ignition of such combustible material and lead both to property damage and personal injury.

Heretofore, it has been recommended that persons operating cutting or welding devices utilizing the fuel and an oxidizer, for example, oxygen, retain a fire extinguishing device in the vicinity for use in extinguishing unexpected fires. Such an arrangement generally is impractical inasmuch as in the event of unexpected combustion the operator of the welding device is required to terminate operation of the welding device and secure the extinguisher. In many instances a resulting fire may be out of control, or irreparable damage may have occurred, before the welder is able to gain control of the situation.

Presently no device is available which permits immediate extinguishment of any unexpected combustion in the vicinity of the welding or cutting operation and immediate termination of fuel supply to the torch.

SUMMARY OF THE INVENTION

The present invention broadly contemplates the provision of fire extinguishing means at the point of operation of a welding torch, utilizing a combustible fuel and oxidizer, for example oxygen.

Additionally, the present invention contemplates an arrangement wherein the supply of combustible material and oxidizer to the welding torch is interlocked with, and controlled by, the availability of fire extinguishing media.

Contrary to prior arrangements, the present invention does not require the operator of the welding device to terminate operation of the device upon occurrence of unexpected combustion and then secure a fire extinguisher. Specifically the devices in accordance with the present invention provide fire extinguishing means directly at the location of work where, in response to occurrence of unexpected combustion in the vicinity of the work, the operator can simply initiate operation of the fire extinguishing arrangement immediately. Devices in accordance with the present invention can also be adapted to immediately terminate the supply of fuel and oxidizer to the work location and allow the operator to utilize the associated welding torch as a fire extinguishing device.

Moreover, the present invention provides straightforward extremely inexpensive valve arrangements for accomplishing the same result.

BRIEF DESCRIPTION OF THE DRAWINGS

Referring now to FIG. 1, the schematic illustration shows one arrangement of a welding-safety apparatus in accordance with the present invention wherein a welding torch 1 is provided for cutting or welding and is adapted to utilize a selected fuel, for example acetylene and an oxidizer material, for example oxygen, in operation of the device.

Figure 1:
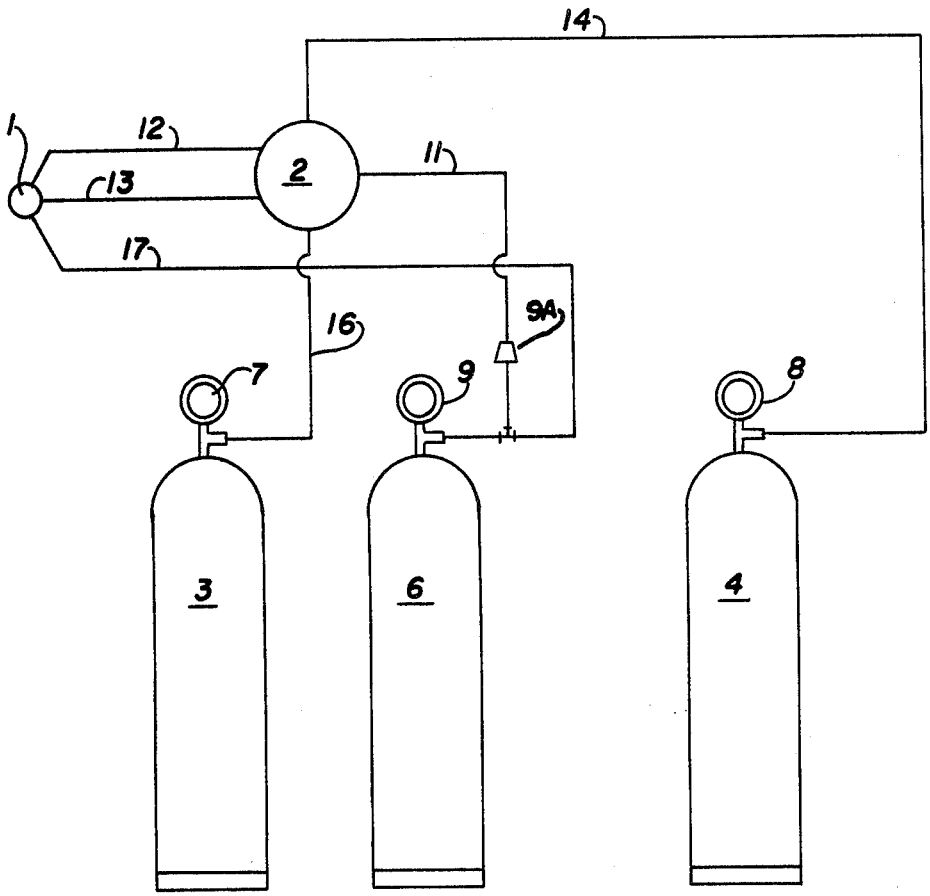
FIG. 1 is a schematic view of one arrangement according to the present invention.

As is known in the art, a pressurized source of acetylene for example an acetylene tank 3, can be provided and adapted to receive a pressure regulator 7 to enable the operator to preselect the acetylene pressure provided to a welding torch 1. Likewise a source of compressed oxygen, for example a pressurized tank 4 can be provided and equipped with a pressure regulator 8 to preselect the pressure of the oxygen provided to torch 1. Pressure regulator 7 of acetylene bottle 3 is connected to a valve means 2, as described hereinafter, by means of a conduit 16 and a second acetylene conduit 13 as provided to interconnect valve 2 and torch 1 as shown.

Likewise, a conduit 14 is provided to connect pressure regulator 8 of oxygen bottle 4 with valve 2, as described hereinafter and a second conduit 12 is provided to connect valve 2 to torch 1 to provide oxygen to the welding torch.

In accordance with one feature of the present invention a source of fire extinguishing material, for example a pressurized tank of compressed carbon dioxide 6 can be provided to be utilized in carrying out the invention provided herein. A pressure regulator 9 can be provided at the outlet of tank 6 to preselect the effective pressure of the carbon dioxide emitted from tank 6. In addition or in the alternative, a safety check valve 9A can be provided to monitor the outlet pressure from tank 6 so that, upon a preselected decrease in pressure at the outlet of tank 6 the source of gas to valve 11 is terminated to close of valve 2 and terminate flow of acetylene and oxygen as hereinafter described. Tank 6 is connected directly to torch 1 by means of a conduit 17 and a second conduit, 11, is provided to connect the outlet of pressure regulator 9 to a chamber in valve 2, as hereinafter described.

Figure 2:
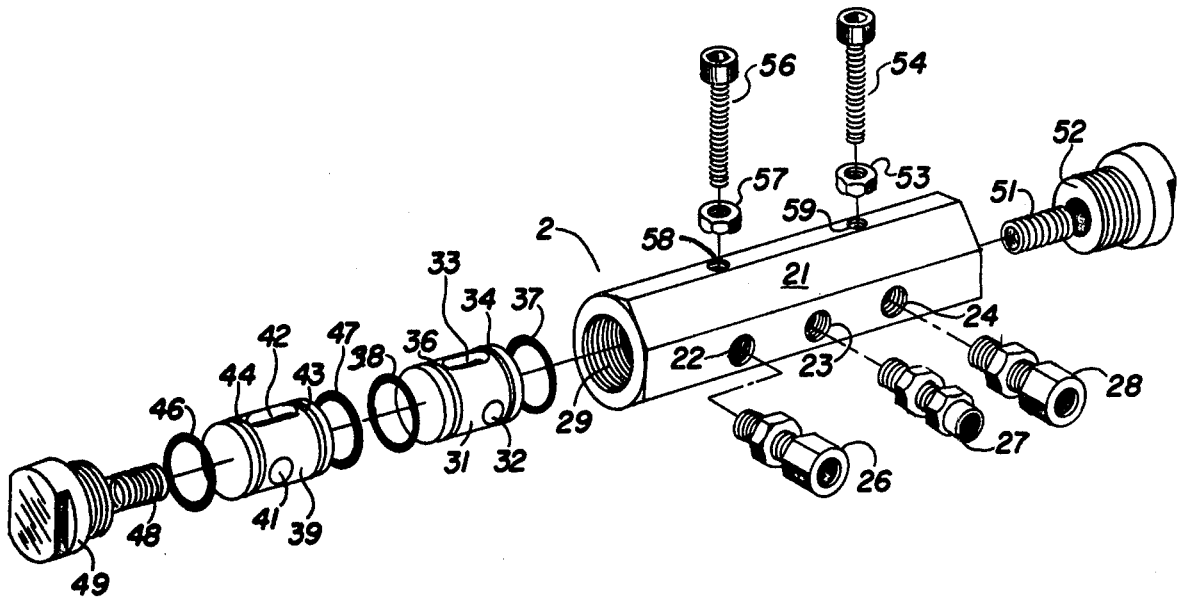
FIG. 2 is an exploded view of a valve arrangement which can be utilized in arrangements within the scope of the present invention.

One example of valve 2 of FIG. 1 within the scope of the present invention is shown in FIG. 2 in exploded view.

The valve includes a generally cylindrical body 21 defining an elongated cylindrical chamber therein. Opposite ends of valve body 21 can be provided with threads 29 (shown on one end only) to receive an end assembly, as described hereinafter, including cooperative caps 49 and 52.

Additionally, first valve port means 22, second valve port means 23, and third valve port means 24 can be provided on one side of valve body 21.

Threaded and capped holes 58 and 59 are provided in one surface of valve body 21 and adapted to receive screws 54 and 56 respectively to be secured in place by means of nuts 53 and 57 as described hereinafter, to direct movement of valve members 31 and 39 as described hereinafter.

Valve ports 22, 23 and 24 are advantageously adapted to receive selected fittings, for example fittings 26, 27 and 28 to connect valve 21 to the pressurized gas storage tanks 3, 4 and 6.

Valve ports 22 – 24, in the example shown, are located on one side of valve body 21 while valve ports 40, 50 are located on the opposite side of valve body 21. In the example shown in the drawings, valve ports 22, 40 and valve ports 24, 50 are in aligned relation while valve port 23 is located intermediate valve ports 22, 24 to communicate with a chamber 60 in valve body 21 defined between the ends of valve members 31, 39 as described hereinafter. It will be recognized that, within the scope of the present invention, the location of the valve ports is determined by the configuration of the valve elements and the mode of operation of the valve.

Valve member assemblies 31 and 39 as hereinafter described are provided to be slidably received within the central chamber defined by valve body 21.

Figure 3:
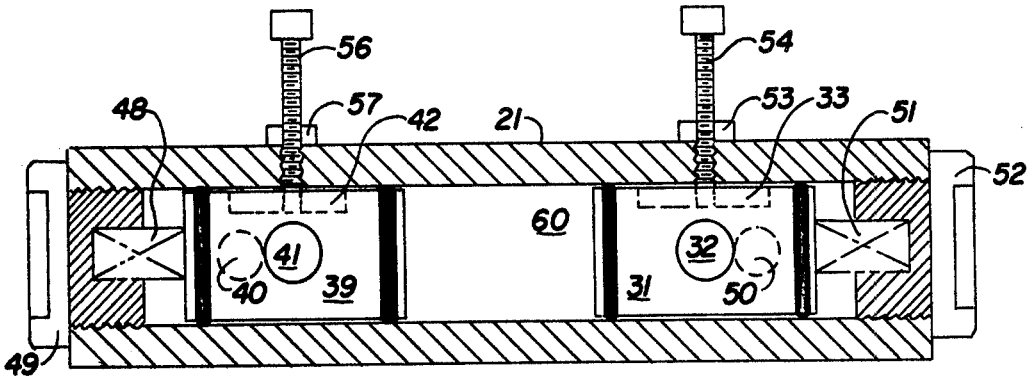
FIG. 3 is a sectional view of an assembled valve as illustrated in FIG. 2.

Referring now to FIG. 3, valve members 31 and 39 are received in the chamber and defined within valve body 21 to slide longitudinally therein as described hereinafter. Each valve member 31, 39 includes a through port, 32, 41 respectively, which extends diametrically through the valve member at a selected location in the valve member depending upon the relative location of ports 22 and 24 of valve body 21. Seal rings 38 and 37 can be provided to be received in grooves 34 and 36 of valve member 31 while seal rings 46 – 47 can be provided to be received within cooperative grooves 43 – 44 of valve member 39 to prevent by-pass of gases from chamber 60 defined within valve body 21 between valve members 31, 39.

As shown, slots 33 – 42 can be cooperatively provided in each of the valve members 31 – 39 respectively, as shown, to receive the ends of screws 56 – 54 as described hereinafter to provide alignment and limited motion to movement of valves 31, 39. End caps 49, 52 can be provided to be received in the opposite ends of valve body 21 and springs 48 and 51 provided to engage the inner surface of caps 49, 52, (where recesses can be provided within the end caps to receive the springs) to provide an inwardly directed spring bias to both valve members when the valve assembly is completed. It will be recognized that in the assembly shown valves 31, 39 are urged toward each other by springs 48, 51 and outwardly by pressure in chamber 60.

Referring now to FIG. 3, wherein an assembled valve member is shown, it will be seen that when caps 49 – 52 are in place, springs 48 – 51 urge valve members 31 – 39 toward each other and the ends of valve members 31, 39 define pressure chamber 60 therebetween.

In accordance with one feature of the present invention springs 48, 51 are selected so that, in response to a preselected pressure within chamber 60, valve members 31, 39 move outwardly so that throughport 41 of valve 39 is in alignment with ports 22 and 40 of valve body 21, and, likewise, throughport 32 of valve member 31 is in alignment with ports 24 and 50 to allow gas flow through valve 2, in response to a decrease in pressure in chamber 60 below a preselected pressure determined by the spring coefficient of springs 48 and 51. Springs 48 and 51 provide a resultant to urge valve members 31 – 39 inwardly with respect to valve body 21 so that ports 41, 32 move out of alignment with the cooperative valve ports to terminate flow of gas through valve 2. As shown, screws 54 – 56 can be extended radially into valve body 21, to be received in slots 33, 42, respectively, to limit travel of valve members 31 – 39 and maintain register of ports 32, 41 with valve body ports 22, 40 and 24, 50.

Figure 4:
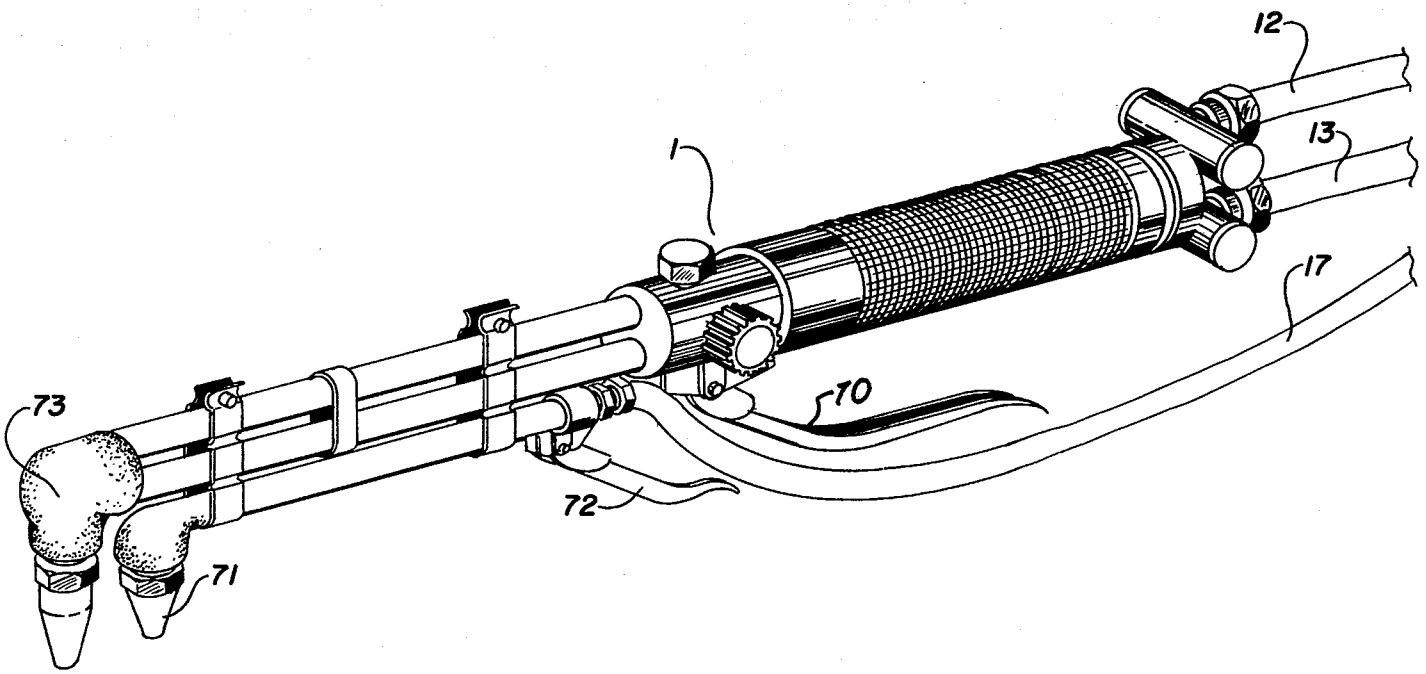
FIG. 4 is an example of a welding torch within the scope of the present invention.

Referring now to FIG. 4, torch 1 can be of the construction known in the art but including an additional nozzle 71 where flow through nozzle 71 is controlled by a valve 72 and where a conduit 17 communicates with the tank 6 to provide the source of extinguishing fluid for example carbon dioxide. Conduits 12 and 13, communicating with valve 2 are also indicated to provide fuel and oxidizer.

In operation, referring to FIG. 1, torch 1 is operated to cut and/or weld as needed. Fuel and oxidizer are supplied to torch 1 from tanks 3 and 4, through valve 2. The pressure of the extinguishing material in tank 6 is applied to chamber 60 of valve 21 to activate valve members 31, 39 to allow flow through valve 2. In the event of the occurrence of unexpected combustion, the operator releases valve 70 and actuates valve 72 to terminate flow of fuel and air through nozzle 73 and initiate flow of an extinguishing material through nozzle 71 so that torch 1 then becomes a fire extinguisher.

In one mode of operation, pressure regulator 9 is set at a preselected pressure, where the pressure is transmitted by means of conduit 11 to valve body port 23 and establishes a selected pressure in chamber 60. Springs 48, 51 are selected so that when the selected pressure is exerted in chamber 60 valve members 31 – 39 move outwardly in chamber 60 to align ports 32 and 41 with ports 22, 40 and 24, 50, as previously described, so that fuel and oxidizer pass through valve 2. Also, within the scope of the present invention, in the event of failure of the extinguishing system, the pressure in the chamber 60 is reduced and releases valves 31, 39 so that springs 51 – 48 urge valve members 31 – 39 into chamber 60 whereby ports 32, 41 move out of alignment with valve ports 22, 40, and 24, 50 as previously described, to terminate flow of fuel and oxidizer through valve 2.

Additionally, it will be recognized that springs 51 – 48 can be further selected so that in the event of occurrence of unexpected combustion, and flow of extinguishing material is initiated through nozzle 71, the pressure at the outlet of regulator 9 decreases to a point below the selected pressure in chamber 60 so that valve members 31, 39 are released, cutting off any passage through valve until the pressure in chamber 60 returns to the preselected minimum. In this manner, the device in accordance with the present invention can be adapted to prevent accidental re-ignition of the flame so long as extinguishing material is flowing through valve 71.

In arrangements where a pressure regulator 9 is not provided and where a pressure check valve 9A alone is provided, valve 2 is actuated only upon a selected decrease in the outlet pressure of tank 6.

It is to be understood that the foregoing is but one example of an apparatus and arrangements in accordance with the present invention and that various arrangements within the scope of the present invention will occur to those skilled in the art upon reading the disclosure set forth hereinbefore.

The invention claimed is:

1. A fire extinguishing/fuel-oxidizer burning torch arrangement including: torch means for combining fuel and oxidizer; fuel supply means to supply selected fluid fuel to said torch means; oxidizer supply means to supply selected fluid oxidizer to said torch means; fire extinguishing material supply means to supply selected fluid fire extinguishing material; valve means including:

(a) first passageway means communicating with said fuel supply means and said torch means with valve member operable from first position;

(b) second passageway means communicating with said oxidizer supply means and said torch means;

(c) valve member means operable from first position to initiate flow of fuel through said first passageway means and flow of said oxidizer through said second passageway means to second position to terminate flow of fuel through said first passageway means and terminate flow of said oxidizer through said second passageway means;

(d) valve member control means responsive to pressure of said fire extinguishing material supply means to operate said valve member means from said first position to said second position upon selected decrease in pressure of said fire extinguishing material.

2. The invention of claim 1 wherein said valve means includes valve body means defining an elongated valve chamber therein and having first valve port communicating with said fuel supply means, second valve port means communicating with said torch means. third valve port means communicating with said oxidizer supply means, fourth valve port means communicating with said torch means and fifth valve port means communicating with said fire extinguishing material supply means therein, each communicating with said valve chamber and wherein said valve member means includes first valve member having a length less than one half the length of said valve chamber to be slidably received within said chamber and having first valve port means therein to selectively communicate with said first and second valve ports when said first valve member is in first position and out of communication with said first and second valve ports when said first valve member is in second position and second valve member having a length less than one half the length of said valve chamber to be slidably received within said chamber and having first valve port means therein to selectively communicate with said third and fourth valve ports when said second valve member is in first position and out of communication with said third and fourth valve ports when said second valve member is in said second position where pressure chamber means is defined in said valve chamber between adjacent ends of said first and second valve members and where said fifth valve port communicates with said pressure chamber.

3. The invention of claim 2, including bias means to selectively urge said first and second valve members to said second position.

4. The invention of claim 3, wherein said bias means are selected so that first and second valve members are urged to said first position in response to preselected minimum pressure of fire extinguisher material in said pressure chamber.

* * * * *